US006261195B1

(12) United States Patent
Shingleton

(10) Patent No.: US 6,261,195 B1
(45) Date of Patent: Jul. 17, 2001

(54) FOOTBALL TRAINING APPARATUS

(75) Inventor: Todd R. Shingleton, 104 Holland Rd., Slippery Rock, PA (US) 16057

(73) Assignee: Todd R. Shingleton, Slippery Rock, PA (US)

( * ) Notice: Subject to any disclaimer, the term of this patent is extended or adjusted under 35 U.S.C. 154(b) by 0 days.

(21) Appl. No.: 09/436,580

(22) Filed: Nov. 9, 1999

Related U.S. Application Data

(63) Continuation-in-part of application No. 08/918,552, filed on Aug. 22, 1997, now Pat. No. 5,980,398.

(51) Int. Cl.[7] ..... A63B 69/34
(52) U.S. Cl. ..... 473/442; 473/438; 473/441
(58) Field of Search ..... 473/422, 441–445, 473/FOR 124, FOR 125

(56) References Cited

U.S. PATENT DOCUMENTS

| | | | | |
|---|---|---|---|---|
| 2,234,364 | * | 3/1941 | Carberry | 473/443 |
| 2,558,081 | * | 6/1951 | Gardenhour | 473/445 |
| 2,696,383 | * | 12/1954 | Noftsinger | 473/441 |
| 3,390,880 | * | 7/1968 | Forrest | 473/441 |
| 3,399,891 | * | 9/1968 | McCormick et al. | 473/442 |
| 3,547,438 | * | 12/1970 | Schmitter | 473/443 |
| 3,556,523 | * | 1/1971 | Hooker | 473/443 |
| 3,659,847 | * | 5/1972 | Gow | 473/443 |
| 4,186,922 | * | 2/1980 | Ketchum | 473/443 |
| 4,447,056 | * | 5/1984 | Dalton | 473/442 |
| 4,534,557 | * | 8/1985 | Bigelow et al. | 473/442 |
| 5,280,905 | * | 1/1994 | Micco | 473/444 |

FOREIGN PATENT DOCUMENTS

| | | | | |
|---|---|---|---|---|
| 265035 | * | 2/1927 | (GB) | 473/FOR 124 |

* cited by examiner

*Primary Examiner*—Jeanette Chapman
*Assistant Examiner*—Mitra Aryanpour
(74) *Attorney, Agent, or Firm*—James Ray & Associates

(57) ABSTRACT

An elongated support member extends generally vertically upward from a playing surface. An elongated arm extends outward from two opposite sides of the support member in generally perpendicular relationship to the support member. The arm has freedom of rotation about the support member. At least two blocking dummy holders are configured to be suspended from the arm such that at least one each of the blocking dummy holders is positioned on each of the two opposite sides of the support member. Each of the blocking dummy holders has freedom of rotation about the arm, whereby a person on the playing surface who strikes a blocking dummy held by the blocking dummy holder will cause the arm to rotate about the support member and the blocking dummy to rotate about the arm.

9 Claims, 5 Drawing Sheets

FOOTBALL TRAINING APPARATUS

CROSS-REFERENCE TO RELATED APPLICATIONS

This application is a continuation-in-part application of co-pending application Ser. No. 08/918,552, filed Aug. 22, 1997, now allowed as U.S. Pat. No. 5,980,398.

FIELD OF THE INVENTION

The present invention relates, in general, to football type blocking dummies and/or sleds which are utilized by a football coach to instruct an offensive lineman in the proper technique to more effectively block a defensive lineman and a defensive player in the proper techniques to more effectively tackle an opponent and, more particularly, this invention relates to an improved training apparatus which will at a minimum provide such coach with the capability of accurately comparing both the blocking and tackling skills of a particular player with respect to the blocking and tackling skills of another player.

DESCRIPTION OF THE RELATED ART

Prior to the conception and subsequent development of the present invention, it is generally well recognized in the football equipment art that football coaches have for a number of years made extensive use of a training apparatus which is commonly known in the football equipment art as a "blocking dummy" in order to more easily teach an offensive lineman to effectively block a defensive lineman. Conversely, these blocking dummies have also been used to teach defensive players proper tackling techniques.

These prior art type blocking dummies have generally consisted of a canvas type cylindrical bag which is filled with a relatively heavy type material. Normally these canvas bags will have at least one strap secured to the side thereof to assist in carrying them to and from the football field. Additionally, the strap is normally used to hold onto while the player attacks the bag from a predetermined blocking or tackling position.

It is also a rather common practice to attach these blocking dummies or other similarly padded devices to sleds. In this case, the players line up and take turns running at the blocking dummy to strike it and attempt to move the sled as far as possible.

While these prior art type blocking dummies and sleds have generally provided the football coach with some needed capability to at least measure and/or make some desirable improvement in the player's blocking technique these blocking dummies possess the inherent disadvantage that they cannot be instrumental in providing such football coach with any significant measure of such player's overall strength with respect to the overall strength of another player.

In the case of blocking dummies attached to sleds, as is the case when teaching blocking techniques to a group of players, momentum is imparted to the sled as each player strikes it. By the time the last player strikes the sled, the sled has far less resistance than that experienced by the first player and with significantly less effort required from the player. This is obviously not the best way of training athletes or of comparing their abilities.

Furthermore, because sleds are movable, they may be stolen if not removed from the field at the end of the practice day.

SUMMARY OF THE INVENTION

The football training apparatus of the present invention includes an elongated support member which extends generally vertically upward from a playing surface. An elongated arm extends outward from two opposite sides of the support member in generally perpendicular relationship to the support member. The arm has freedom of rotation about the support member. At least two blocking dummy holders are configured to be suspended from the arm such that at least one each of the blocking dummy holders is positioned on each of the two opposite sides of the support member. Each of the blocking dummy holders has freedom of rotation about the arm, whereby a person on the playing surface who strikes a blocking and/or dummy held by the blocking dummy holder will cause the arm to rotate about the support member and the blocking dummy to rotate about the arm.

OBJECTS OF THE INVENTION

It is, therefore, one of the primary objects of the present invention to provide a football training apparatus which will enable a football coach to simultaneously measure a first player's relative speed, power, and blocking technique against those of a second player, and to instruct both players in developing the proper blocking and/or tackling skills.

Another object of the present invention is to provide a football player's training apparatus which does not require removal of the entire apparatus from the practice area at the end of each practice session.

Still another object of the present invention is to provide a football player's training apparatus which is relatively easy to use.

Yet another object of the present invention is to provide a football player's training apparatus which does not require someone to hold during use.

A further object of the present invention is to provide a football training apparatus which can be used to train both offensive and defensive players.

An additional object of the present invention is to provide a football training apparatus which can also be used to teach running backs to hit a hole and to attack the line in a better driving position, i.e., lower.

Still yet another object of the present invention is to provide a football training apparatus which can be readily and easily assembled, disassembled and reconfigured without the use of tools.

Yet still another object of the present invention is to provide a football training apparatus which can be configured to represent multiple defensive and offensive functions and which can be useful in training when not enough players are present for both an offensive and defensive team to practice.

A still further object of the present invention is to provide a football training apparatus which can provide varying resistance as desired.

Yet still another object of the present invention is to provide a football training apparatus which can be used year round and both indoors and outdoors.

In addition to the various objects and advantages of the football training apparatus described above, various other objects and advantages of the present invention will become much more readily apparent to those persons who are skilled in the relevant football art from the following more detailed description of the invention, particularly, when such detailed description is taken in conjunction with both the attached drawing figures and with the appended claims.

BRIEF DESCRIPTION OF THE DRAWINGS

FIG. 5 is a diagram representing multiple configurations the football training apparatus of the present invention can be easily configured in.

DETAILED DESCRIPTION OF THE INVENTION

Figure 1:
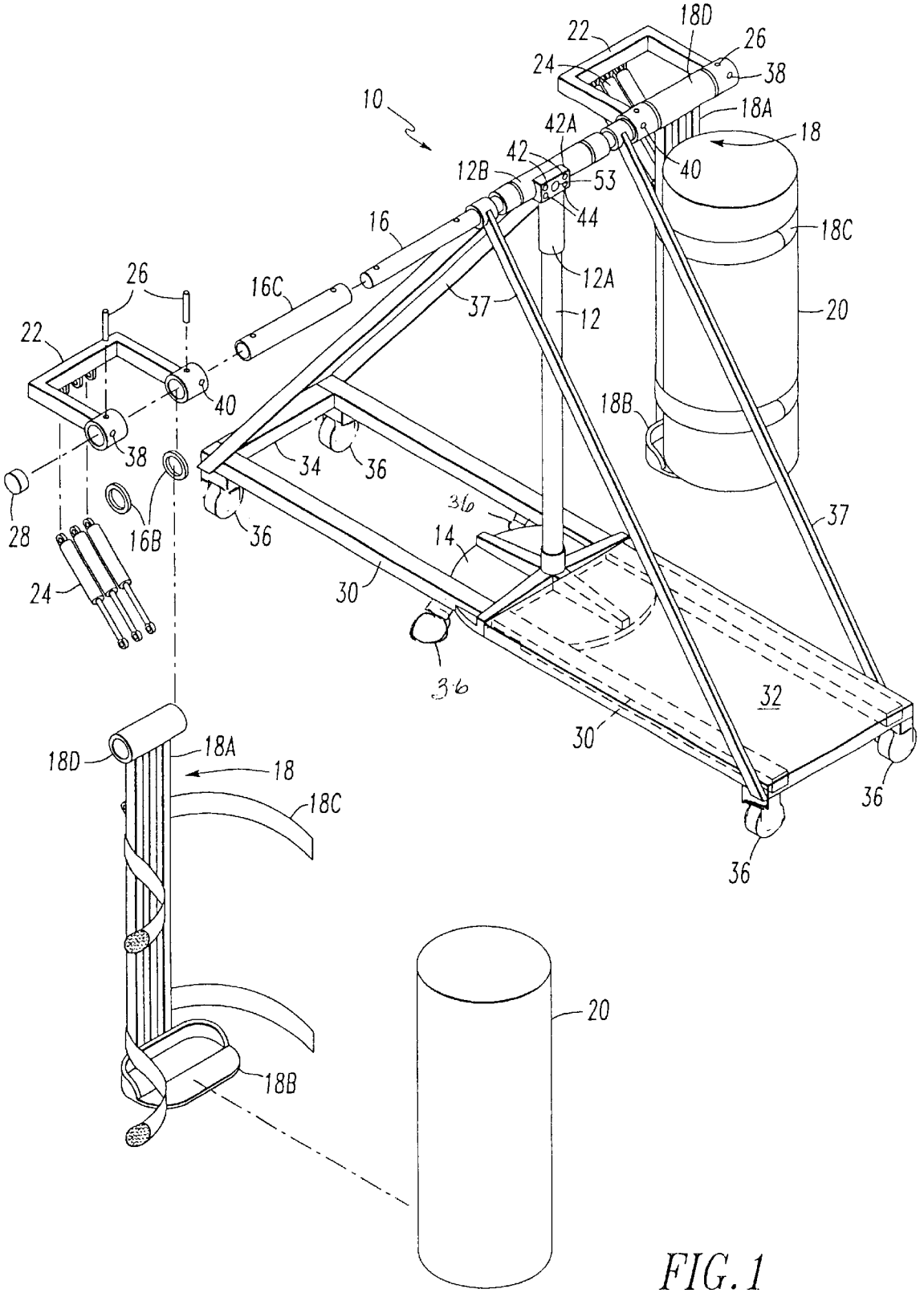
FIG. 1 is a perspective view of a presently preferred embodiment of the football training apparatus of the present invention.
Figure 2:
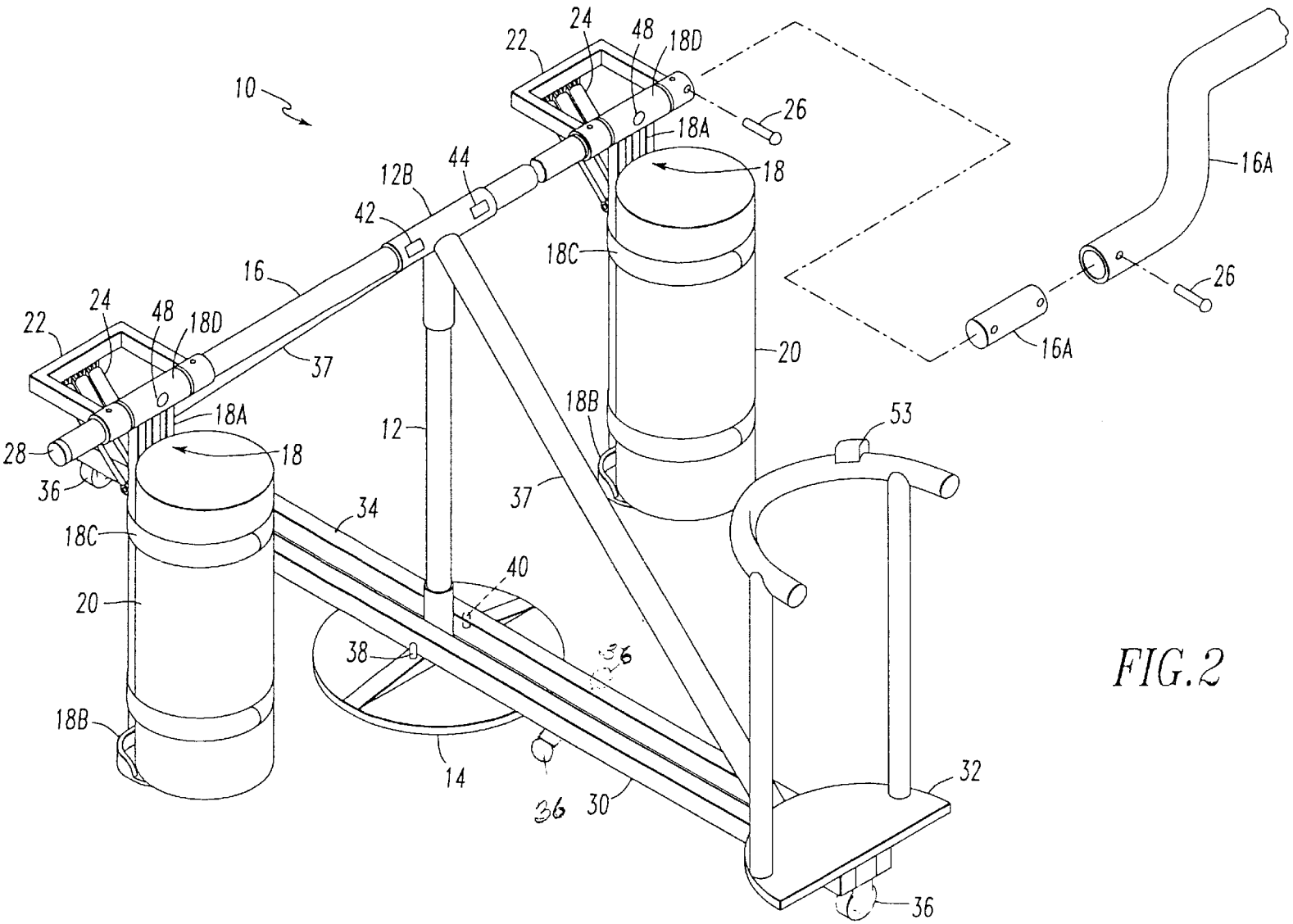
FIG. 2 is a perspective view of another embodiment of the football training apparatus according to the present invention.

Prior to proceeding to the more detailed description of the present invention, it should be noted that for the sake of clarity and understanding of such invention, identical components which have identical functions have been identified with identical reference numerals throughout the several views that have been illustrated in the attached drawing figures.

Reference is now made more particularly, to FIG. 1, which is a perspective view of the sport training apparatus 10 of the present invention. An elongated support member 12 extends upwardly from a stand 14, and includes a sleeve 12A at a distal end thereof. The elongated support member 12 is configured in a known manner to rotate about a longitudinal axis of the support member 12.

An elongated arm 16 extends though a horizontally disposed sleeve 12B attached to the sleeve 12A and extends outward from two opposite sides of the support member 12 in a substantially perpendicular relationship to the support member 12; thus, the arm 16 has freedom of rotation about the support member 12.

A blocking dummy holder 18 is attached to the arm 16 on each side of the support member 12. Each blocking dummy holder 18 includes a back member 18A, constructed as shown of three pipe members; however various embodiments of the back member 18A are within the scope of the present invention.

A seat 18B at one end of the back member 18A is adapted for a blocking dummy 20 to rest thereon. Straps 18C extending from the back member 18A hold the blocking dummy 20 against the back member 18A.

At another end of the back member 18A opposite of the seat 18B, the back member 18A is attached to a blocking dummy holder sleeve 18D which is configured to freely rotate about the arm 16. The sleeve 18D rides on a Teflon sleeve 16C and Teflon washers 16B.

A brace 22 is fixedly attached to the arm 16 at each blocking dummy holder 18. Resistance devices 24 are attached between the back member 18A and the brace 22. Striking the blocking dummy 20 will cause the blocking dummy holder 18 to pivot upward about the arm 16 and to urge against the resistance device 24. The resistance device 24 may be any conventional device such as a hydraulic or spring-loaded cylinder. The resistance provided by the resistance devices 24 is variable by varying the amount of resistance devices 24 attached to the blocking dummy holder 18.

Figure 3:
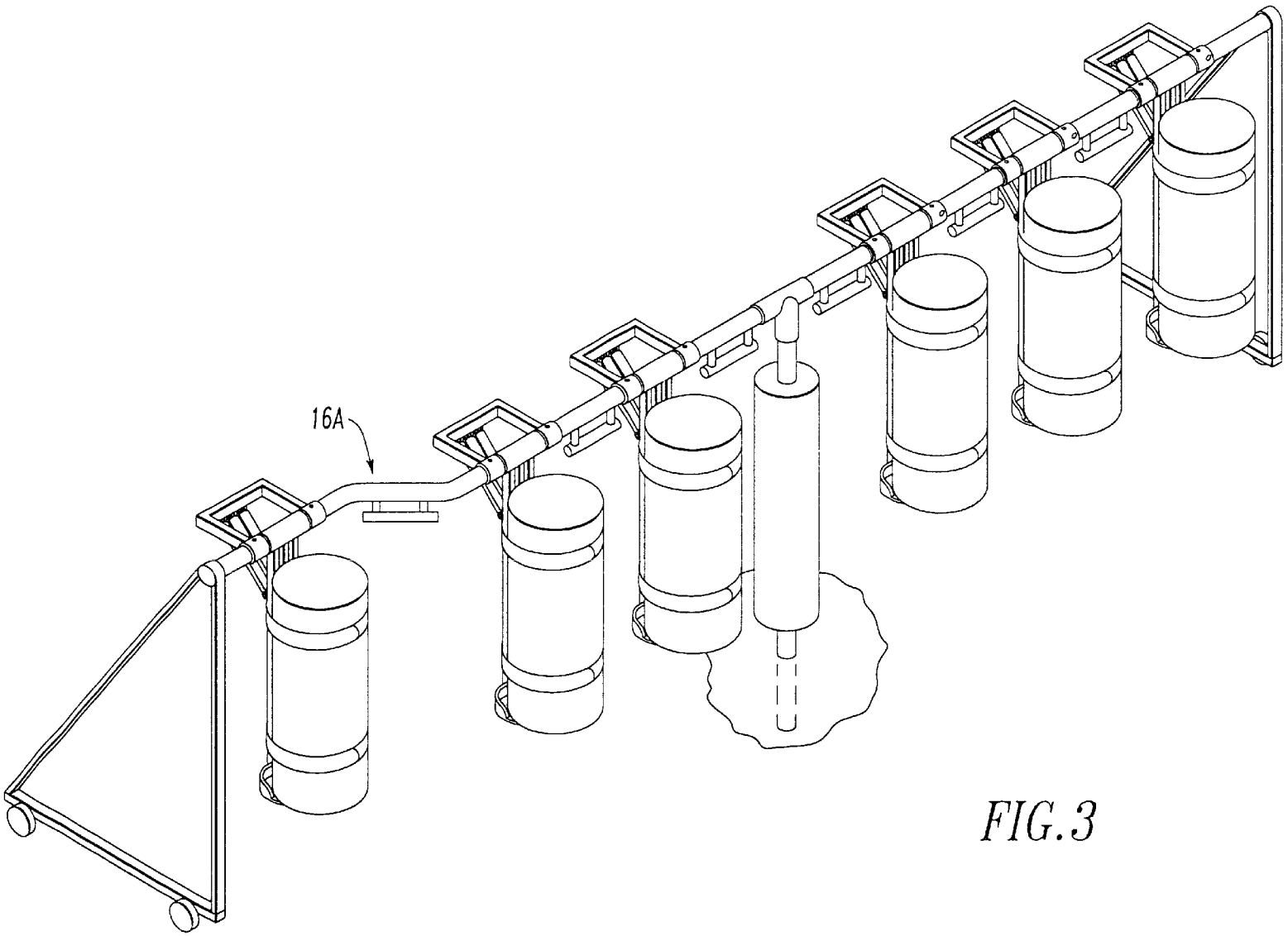
FIG. 3 is a perspective view of another alternative embodiment of the present invention.

The arm 16 may be extended on either side of the support member 12 with additional straight or bent arm members 16A (see FIG. 3) and fasteners 26, (see FIG. 1). The arm 16 may be, and preferably is, finished with a cap 28.

A platform holding arm 30 extends outwardly from the support member 12,. generally perpendicular to the arm 16. A platform 32 is positioned at a distal end of the platform holding arm 30, for a coach or instructor to stand thereon. A counterweight arm 34 extends outwardly from the support member 12 opposite of the platform holding arm 30. The counterweight arm 34 provides a counterweight to the platform holding arm 30 and the platform 32 thus keeping the support member 12 from tipping. Wheels 36 are attached onto the bottom of the platform holding arm 30 and/or the counterweight arm for providing rolling support of the platform holding arm 30, the platform 32, and the counterweight arm 34. These wheels are capable of swiveling 360° to enable movement of the apparatus in a variety of directions.

Cross members 37 extend between the platform holding arm 30 and the elongated arm 16, and between the counterweight arm 34 and the elongated arm 16, for increased stability.

A speed/quickness switch 38 is attached to member 22 and configured in a known manner to change status when blocking dummy holder 18 rotates in a predetermined direction. Speed/quickness indicators (two) are attached to a light display panel 42A which is attached to member 12A. The apparatus 10 is configured in a known manner such that a speed/quickness indicators 42 illuminates when the speed/quickness switch 38 is the first to change status. Only one speed/quickness indicator will illuminate, that being the first to change status. This is valuable to a coach who wishes to compare two players to see who strikes the blocking dummy 20 first. If the player (not shown) to the right of the arm 16 rotates the dummy holder 18 first, by striking the dummy 20 first, the speed/quickness indicator 42 on the right side of the light display panel 42A will illuminate. In a like manner, the speed/quickness indicator on the left side of the light display panel 42A will illuminate when the dummy holder 18 on the left side of the arm 16 is the first to rotate. The above described functions may be implemented easily without undue experimentation by one skilled in the art of using conventional electrical or electronic circuitry.

A strength/technique switch 40 is attached to member 22 and configured in a known manner to change status when member 18 rotates in a predetermined direction in its full travel state. Strength/technique indicators (two) are attached to a light display panel 42A which is attached to member 12A. The apparatus 10 is configured in a known manner such that a strength/technique indicator 44 illuminates when the strength/technique switch 40 is the first to change status. Only one strength/technique indicator will illuminate, that being the first to change status. This is valuable to a coach who wishes to compare two players to see who displays better form by hitting the blocking dummy 20 low enough to be the first to lift the blocking dummy 20 a predetermined distance. If the player (not shown) to the right of the arm 16 rotates the dummy holder 18 by a predetermined distance before the player on the left does, a strength/technique switch 44 on the right side of the light display panel 42A will illuminate. In a like manner, the strength/technique indicator on the left side will illuminate when the dummy holder 18 on the left side of the arm 16 is the first to rotate a predetermined distance. The above described functions may be implemented easily without undue experimentation by one skilled in the art of using conventional electrical or electronic circuitry.

The speed/quickness and strength/technique switches and indicators 38, 40, 42 and 44 may be reset by a controller 53 located at the base of the light display panel 42A. The above described functions may be implemented easily without undue experimentation by one skilled in the art using conventional electrical or electronic circuitry.

Figure 4:
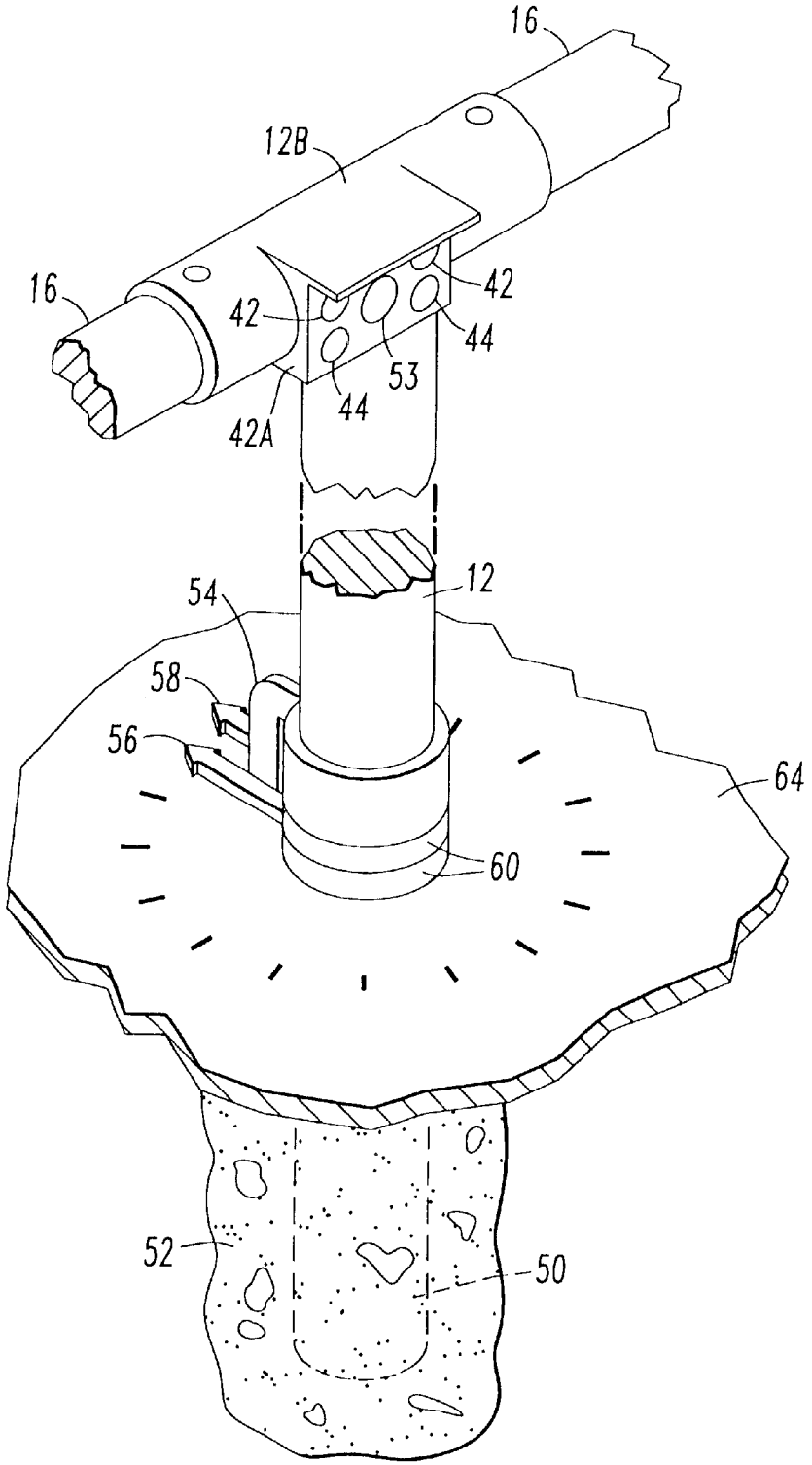
FIG. 4 is an enlarged view of one arrangement for measuring a players ability.
Figure 5:
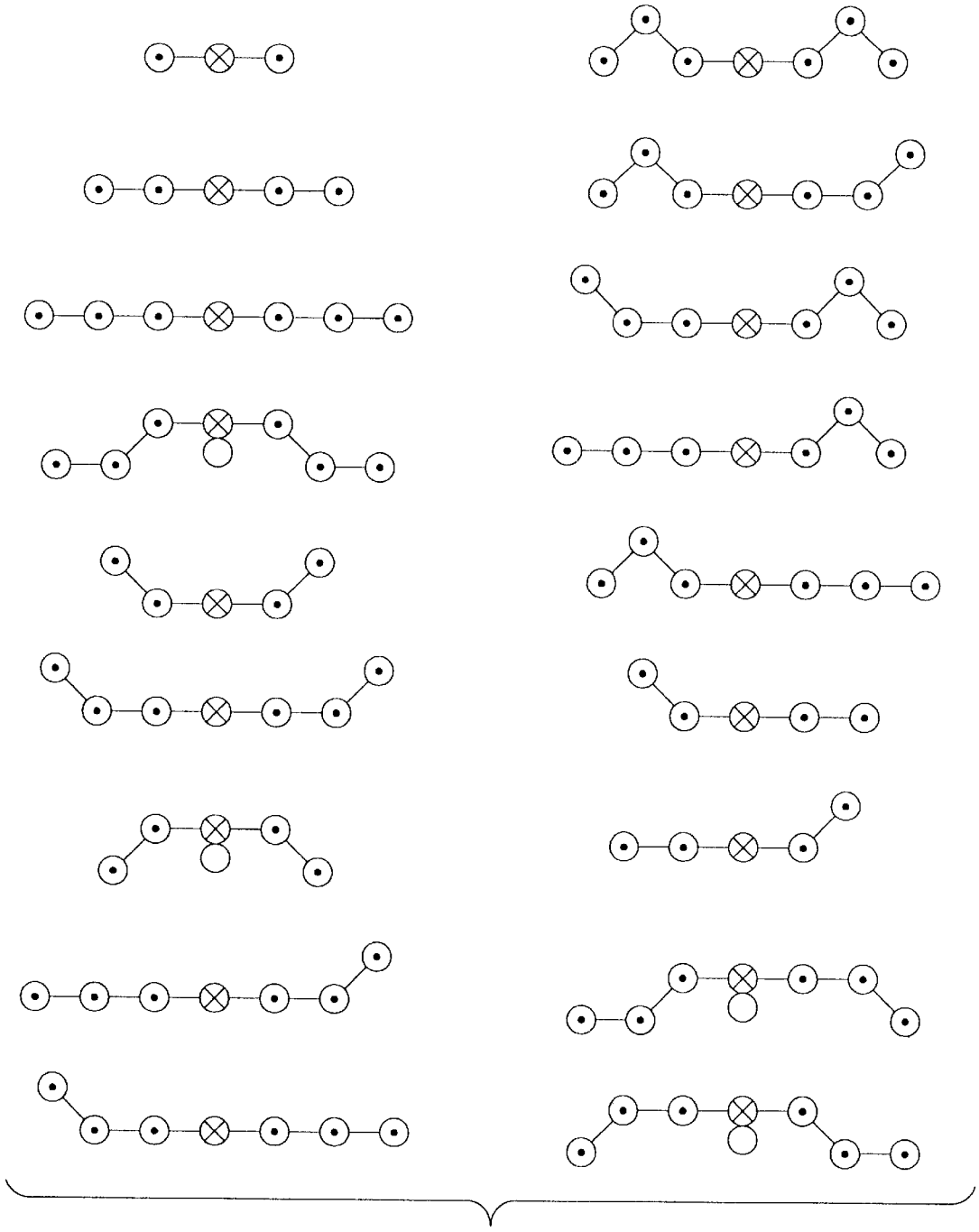

FIG. 4 is a partial enlarged perspective view of another embodiment of the apparatus 10, wherein the stand 14 is deleted and the support member 12 is, preferably, inserted into a buried sleeve 50 within concrete 52. In such a configuration, the stability provided by the wheels 36, the platform holding arm 30 and the counterweight arm 34 may not be required, and can be deleted.

A pointer mover 54 is radially extended from the support member 12. A first pointer 56 and a second pointer 58 are each rotatably connected to the support member 12 in a known manner, such as by sleeve members 60. The pointer mover 54 will urge against either of the first and second pointers 56, 58, depending on which way the arm 16 rotates. Indicia 62 marked on a pointer resting surface 64 (which may be a part of the apparatus 10, or finished concrete on grade), give a graduated indication of how far the arm 16 has rotated. This is valuable to a coach who wishes to compare two players to see who displays greater power by driving the arm 16A greater distance.

The foregoing description is included to describe embodiments of the present invention which include the preferred embodiment, and is not meant to limit the scope of the invention. From the foregoing description many variations will be apparent to those skilled in the art that would be encompassed by the spirit and scope of the invention. Accordingly, the scope of the invention is to be limited only by the following claims and their legal equivalents.

I claim:

1. A football training apparatus, said apparatus comprising:

(a) a base member;

(b) an elongated support member engaged at a first end thereof with said base member and adapted to extend generally vertically upward from a playing surface;

(c) an elongated arm configured to extend outward from two opposite sides of said support member in a generally perpendicular relationship to said support member, said elongated arm being capable of rotating about said support member;

(d) at least two blocking dummy holders, each of said blocking dummy holders being capable of rigidly holding a blocking dummy therein, each of said at least two blocking dummy holders being configured to be suspended from said elongated arm such that at least one of each of said blocking dummy holders is positioned on each of two opposite sides of said support member, whereby a force applied by a person positioned on the playing surface to at least one of said blocking dummies held by said blocking dummy holder will cause said elongated arm to rotate about said support member; and (e) each of said at least two blocking dummy holders are supported for freedom of rotation about said elongated arm by a stem whereby a force applied by a person positioned on the playing surface who strikes a blocking dummy held by said blocking dummy holder will cause said elongated arm to rotate about said support member and said blocking dummy holder to rotate about said elongated arm.

2. The football training apparatus, according to claim 1, wherein said apparatus further includes a plurality of resistance devices configured for attachment between each of said blocking dummy holders and a brace configured for fixed attachment to said elongated arm, such that striking a blocking dummy within said blocking dummy holder will cause said blocking dummy holder to urge against said resistance device, and wherein a number of resistance devices attached to each of said blocking dummy holders is variable.

3. The football training apparatus, according to claim 2, wherein at least two of said blocking dummy holders includes a switch configured for attachment to one of said resistance devices, and wherein said switch is configured to initiate a signal when said switch is a first switch to be closed due to movement of said blocking dummy holder against said resistance device by a predetermined amount.

4. The football training apparatus, according to claim 3, wherein said signal is one of visual and audio.

5. The football training apparatus, according to claim 4, wherein said signal is visual.

6. The football training apparatus, according to claim 1, wherein said apparatus further includes a pointer member which is radially extended from said support member and a first and a second pointer each having freedom of rotation about said support member, the pointer member being configured to urge against and rotate said first pointer when said elongated arm rotates in a first direction, said pointer member being further configured to urge against and rotate said second pointer when said elongated arm rotates in a second direction, whereby a direction and amount of rotation of said elongated arm is ascertainable from inspection of said first and second pointers.

7. The football training apparatus, according to claim 1, wherein said apparatus further includes a platform holding arm extended outwardly from said support member, and a platform disposed at a distal end of said platform holding arm adapted for a person to stand thereon.

8. The football training apparatus, according to claim 6, wherein said apparatus further includes a counterweight arm member extending outwardly from said support member opposite said platform holding arm, said counterweight arm member providing a predetermined counterweight to said platform holding arm and a platform disposed thereon, thus keeping said support member from tipping.

9. The football training apparatus, according to claim 1, wherein said base includes a plurality of swivel wheels enabling movement of the football training apparatus.

* * * * *